US005871152A

United States Patent [19]

Saney

[11] Patent Number: 5,871,152

[45] Date of Patent: Feb. 16, 1999

[54] REMOTE CONTROLLED CARPET CLEANER

[76] Inventor: Bahman B. Saney, 7203 Bellerive, Apt. 364, Houston, Tex. 77036

[21] Appl. No.: 904,136

[22] Filed: Jul. 31, 1997

[51] Int. Cl.[6] ..... A47L 11/34

[52] U.S. Cl. ..... 239/8; 15/321; 15/339; 239/13; 239/129; 239/305

[58] Field of Search ..... 15/314, 320, 321, 15/339; 239/8, 13, 129, 305, 307

[56] References Cited

U.S. PATENT DOCUMENTS

| | | | |
|---|---|---|---|
| 3,322,350 | 5/1967 | Heinicke et al. | 239/172 |
| 3,626,545 | 12/1971 | Sparrow | 15/339 X |
| 4,158,248 | 6/1979 | Palmer | 15/340.1 X |
| 4,244,079 | 1/1981 | Bane | 15/321 |
| 4,284,127 | 8/1981 | Collier et al. | 239/129 X |
| 5,383,605 | 1/1995 | Teague | 239/526 |
| 5,749,526 | 5/1998 | Laabs et al. | 239/307 |

*Primary Examiner*—Chris K. Moore
*Attorney, Agent, or Firm*—Jackie Lee Duke

[57] ABSTRACT

A remote controlled carpet cleaner includes a rectangular outer support frame of structural steel. A gasoline engine drives a vacuum pump and through a pulley and belt assembly is also powers a liquid pump. The exhaust gas from the engine is directed to a heat exchanger which is used to heat water which is pumped through the heat exchanger by the liquid pump. A liquid injector allows carpet cleaning chemicals to be mixed with the water as it enters the pump. The liquid injector is connected to a plurality of solenoid valves. Each solenoid valve is connected to a tank containing a carpet cleaning chemical. When a solenoid valve is opened, a specific carpet cleaning chemical in drawn into the liquid injector and mixed with the water entering the pump. The opening and closing of the solenoid valves is controlled by servo motors operated by a radio controlled receiver. The operator carries a belt mounted transmitter unit which transmits signals to the receiver to thereby direct the opening and closing of the solenoid valves and thus the carpet cleaning chemical to be dispensed. The transmitter unit includes a "lockout" feature to prevent the accidental dispensing of the wrong chemical. The remote controlled carpet cleaner offers a substantial increase in productivity by offering an operator the ability to remotely control and dispense required cleaning chemicals without making repeated trips between the cleaning site and a supply truck.

8 Claims, 4 Drawing Sheets

REMOTE CONTROLLED CARPET CLEANER

BACKGROUND OF THE INVENTION

1. Field of the Invention

This invention relates to an improved carpet cleaning machine used in home and commercial carpet cleaning operations which allows an operator to dispense needed cleaning chemicals by remote control. These carpet cleaning machines are typically truck mounted. An operator parks the truck adjacent the customer's home or office and unrolls a sufficient amount of hose to extend from the truck mounted carpet cleaning machine to the carpet to be cleaned. The hose is of two part construction with a smaller diameter hose supplying heated water to the operator's leaning wand for carpet cleaning. A second larger diameter hose is connected to the cleaning wand which allows the operator to vacuum excess water and dirt from the carpet. A control valve mounted on the wand allows switching between cleaning and vacuuming modes.

The other ends of these hoses are connected to the truck mounted carpet cleaning machine. This truck mounted carpet cleaning machine includes a heat exchanger for heating the water which is to be used during cleaning. It also includes a vacuum pump for suctioning the excess water and dirt from the carpet and a storage tank for the used, dirty water. A small gasoline engine is typically used to run the vacuum pump and a triplex liquid pump, and heat the water.

In order to better clean the carpet an operator uses various chemicals during a typical cleaning operation. Most often used is a detergent which must be premixed with the hot water before it is sprayed onto the carpet. If an operator mixes too large a volume of water and detergent for the job, expensive detergent is wasted. If too small a volume is mixed, the operator must stop the cleaning operation and return to the truck and mix additional water and detergent, thereby wasting time on the job.

A second chemical often used during a typical carpet cleaning operation is a degreaser or "prespotter" as it called in the industry. The use of the prespotter requires an operator to around the home or office prior to beginning the cleaning operation and squirt the prespotter onto the carpet from a small hand held sprayer. This method is inefficient in requiring the operator to carry around these sprayers along with the cleaning wand.

A third chemical used is an odor remover which is very expensive and harmful to people if inhaled. Additionally, once the enzyme is mixed with water it has a useable life of 30 minutes. The amount of enzyme required for a job is often hard to estimate. If an operator mixes too large an amount of the enzyme for the job, it is wasted. Additionally, any unused water and enzyme mixture must be properly disposed of according to environmental regulations. This disposal time can be costly for the operator as time is lost from other cleaning jobs, thereby adversely affecting profitability.

A major improvement of the remote controlled carpet cleaner is the increased safety for the operator and customer. As noted above current typical current carpet cleaning operations require the spraying of chemicals prior to the carpet cleaning operation. This introduces airborne chemicals into the customer's home or office which is undesirable as the operator is exposed to the airborne chemicals during the cleaning operation. Additionally, some of the chemicals remain in the air after the cleaning operation is completed and the customer is exposed to the chemicals also. A final adverse aspect of the use of sprayed chemicals is overexposure of the carpet itself to the chemicals which can cause damage. The remote controlled carpet cleaner of the current invention eliminates these problems by eliminating the need to use chemical sprays before commencing cleaning operations and ensuring the chemicals are dispensed when mixed with water and only in the required carpet areas.

Problems associated with the current technology carpet cleaning machines include difficulty in estimating the amount of chemicals required for a particular carpet cleaning operation, the need for premixing chemicals before a carpet cleaning operation can begin, the need for an operator to carry several sprayers to dispense chemicals before and during the carpet cleaning operation, the need for an operator to make repeated trips to the truck for these chemicals, and the need to dispose of used chemicals in an environmentally safe manner. Typical current carpet cleaners require the use of a two person crew to mix the chemicals and operate the cleaning equipment. The remote controlled carpet cleaner of the current invention eliminates the need for the second person thereby saving labor costs while allowing efficient and safer cleaning operations to be performed. Additionally, the remote controlled carpet cleaner offers a substantial increase in productivity by allowing the operator to dispense the needed chemicals without making repeated trips to the truck, eliminating the need for premixing the chemicals, allowing the operator to dispense the needed chemicals in the required amount thereby eliminating waste and the need to dispose of unused chemicals. This is all done with a compact remote control unit which the operator can operate without returning to the truck or setting aside his cleaning wand.

2. Description of Related Art

Various types of carpet cleaning machines are well known in the prior art. These prior devices all fail in one or more aspects to address the problems described.

SUMMARY OF THE INVENTION

In view of the disadvantages with the known types of carpet cleaning machines, the present invention provides a remote controlled carpet cleaner which allows an operator to selectively dispense cleaning chemicals as required by means of a remote control worn by the operator. The remote controlled carpet cleaner of the present invention allows an operator to avoid having to premix carpet cleaning chemicals before beginning a cleaning operation. This is done with a radio controlled transmitter receiver combination similar to that used in radio controlled model airplanes.

The remote controlled carpet cleaner includes a rectangular outer support frame of structural steel. Mounted within this outer support frame is a gasoline engine which drives a vacuum pump. A pulley and belt assembly is also driven by the engine to power a liquid pump. The exhaust gas from the engine is directed to a heat exchanger which is used to heat water which is pumped through the heat exchanger by the liquid pump. A liquid injector allows carpet cleaning chemicals to be mixed with the water as it enters the pump. The liquid injector is connected to a plurality of solenoid valves. Each solenoid valve is connected to a tank containing a carpet cleaning chemical. When a solenoid valve is opened, a specific carpet cleaning chemical in drawn into the liquid injector and mixed with the water entering the pump.

The opening and closing of the solenoid valves is controlled by servo motors operated by a radio controlled receiver. The operator carries a belt mounted transmitter unit which transmits signals to the receiver to thereby direct the opening and closing of the solenoid valves and thus the carpet cleaning chemical to be dispensed. The transmitter unit includes a "lockout" feature to prevent the accidental dispensing of the wrong chemical.

It is a principal object of the present invention to provide a remote controlled carpet cleaner which offers a substantial increase in productivity by offering an operator the ability to remotely control and dispense required cleaning chemicals without making repeated trips between the cleaning site and a supply truck.

Another principal object of the present invention is to provide a remote controlled carpet cleaner which can be used without requiring the premixing of carpet cleaning chemicals.

Another object of the present invention is to provide a remote controlled carpet cleaner which may be used without requiring the use of spraying chemicals prior to use thereby reducing airborne solvents in a customer's home or business.

A final object of the present invention is to provide a remote controlled carpet cleaner which improves the efficiency of the carpet cleaning chemicals to by allowing them to be injected with hot water during the cleaning operation.

These with other objects and advantages of the present invention are pointed out with specificness in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENT

Figure 1:
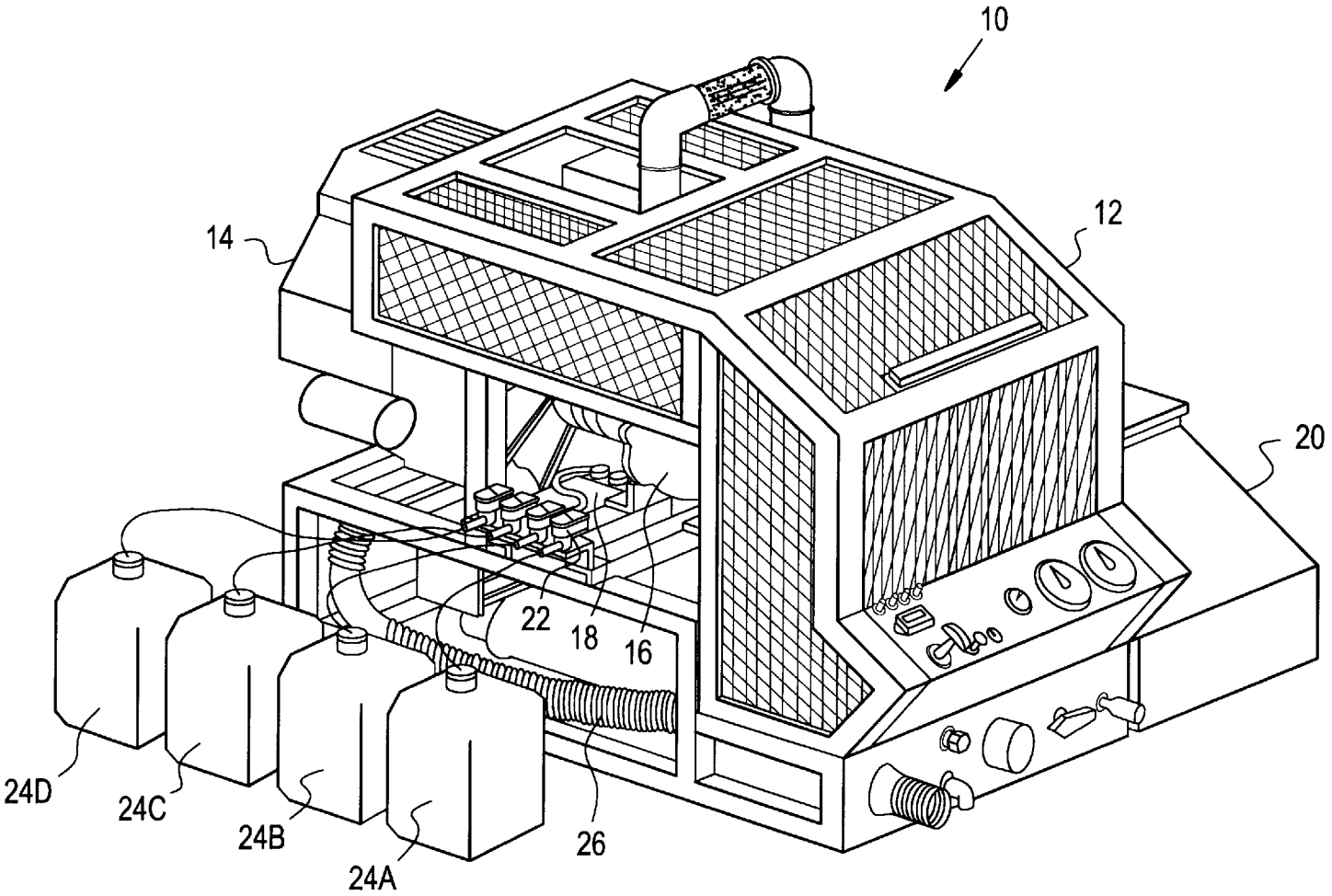
FIG. 1 is an isometric view of the remote controlled carpet cleaner of the present invention.

With reference to the drawings, and particularly to FIG. 1, an isometric view of the remote controlled carpet cleaner and its mounting frame is shown. The main components of remote controlled carpet cleaner 10 include rectangular outer support frame 12, gasoline engine 14, vacuum pump 16, liquid pump 18, recovery tank 20, solenoid valves 22, chemical supply bottles 24*a–d* and suction hose 26. Assorted piping, valves, gauges and electrical controls which will be described in greater detail hereinafter complete the system.

Figure 2:
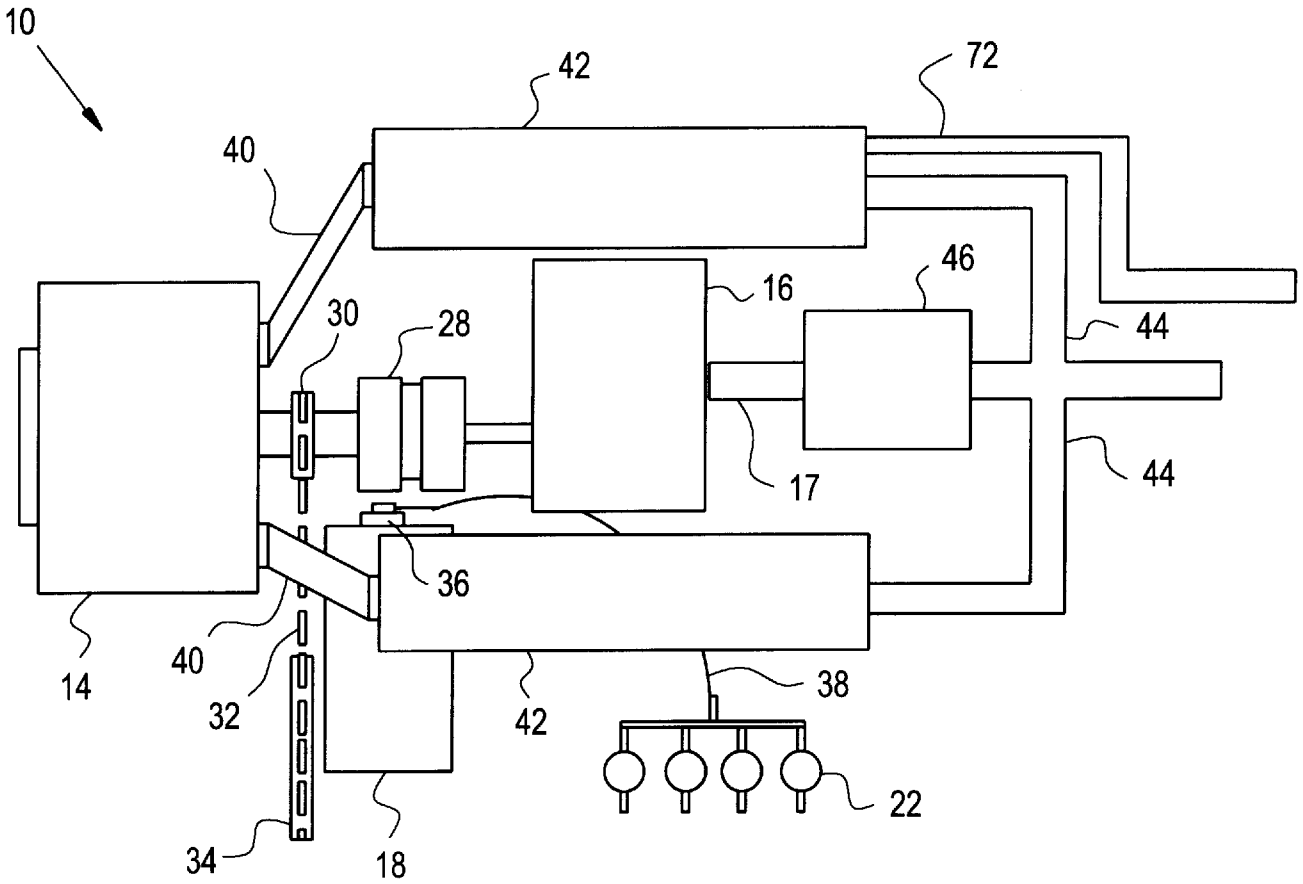
FIG. 2 is a block diagram showing the position and connections between the principal components of the remote controlled carpet cleaner.

FIG. 2 shows a block diagram of the remote controlled carpet cleaner 10 of the present invention. Gasoline engine 14 drives vacuum pump 16 through flexible coupling 28. The exhaust of vacuum pump 16 is routed through piping 17 to muffler 46. A pulley 30 mounted on engine 14 drives triplex liquid pump 18 through belt 32 and pulley 34. Liquid injector 36 is connected to the inlet side of triplex liquid pump 18. Piping 38 connects liquid injector 36 to solenoid valves 22 which are connected to chemical supply bottles 24*a–d* as previously described. Piping 40 routes the exhaust gas of gasoline engine 14 to heat exchangers 42. Heat exchangers 42 are of shell and tube configuration with the exhaust gas flowing through the shell and water flowing through the inner tube where it is heated. The exhaust gas is then routed through piping 44 to the exhaust side of muffler 46. The heated water exits the heat exchangers 42 through piping 72 where it is directed to the operator's cleaning wand.

Figure 3:
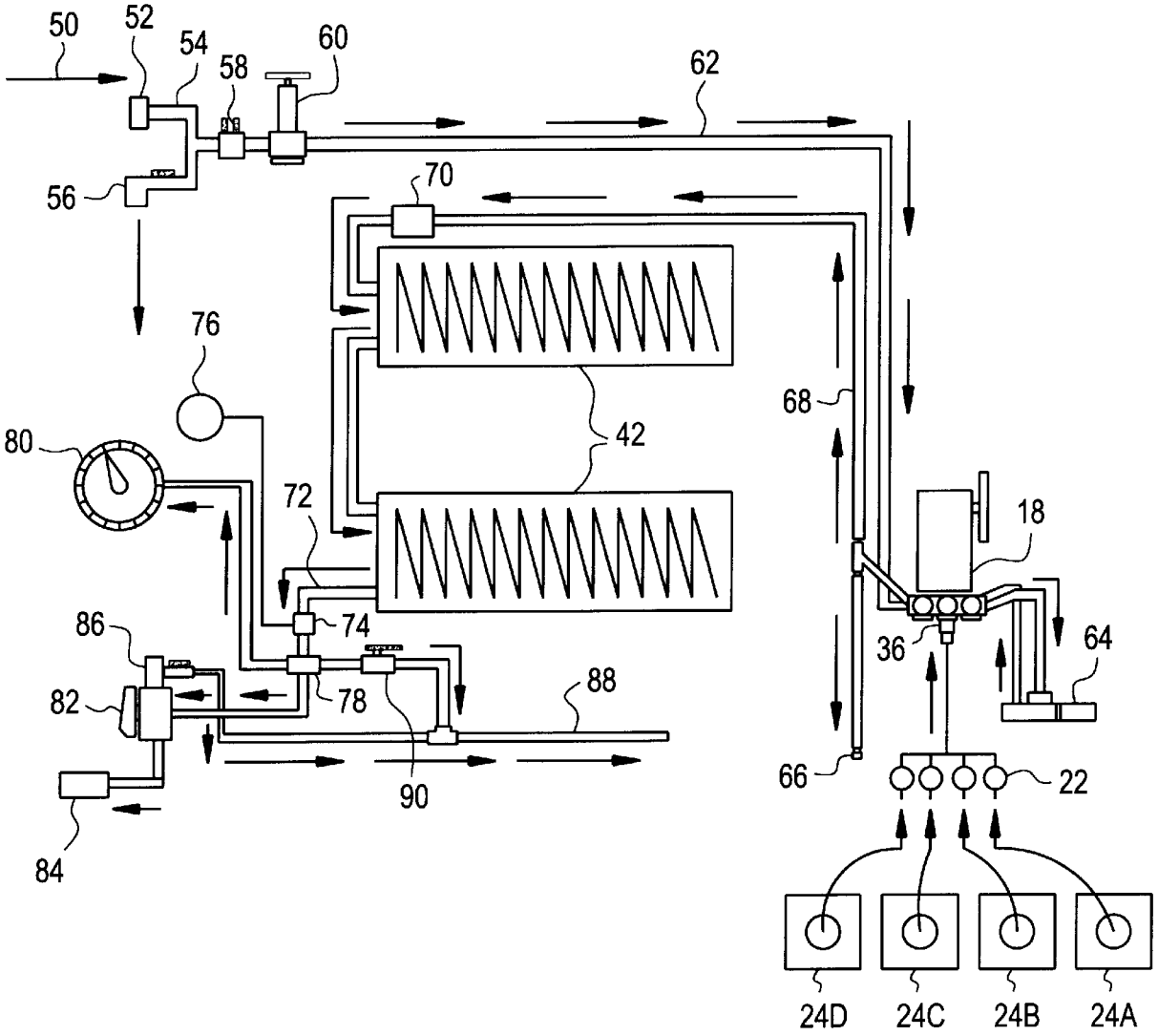
FIG. 3 is a plumbing diagram of the remote controlled carpet cleaner.

FIG. 3 is a detailed plumbing diagram of the remote controlled carpet cleaner 10 of the present invention. Water flow 50 enters the remote controlled carpet cleaner 10 through water inlet fitting 52. Piping 54 directs the water flow 50 to auxiliary valve 56 and water flow switch 58. Auxiliary valve 56 allows an operator access to fresh water. Water flow switch 58 serves as a safety switch to cut off engine 14 should the water supply be interrupted, thereby preventing overheating and damage to heat exchangers 42. Adjacent water flow switch 58 is water pressure regulator 60 which regulates the inlet water pressure to triplex liquid pump 18 to ensure proper operation of liquid injector 36. Triplex liquid pump 18 is a three piston pump of conventional design well known to those of ordinary skill in the art which is driven by engine 14 as previously described.

Bypass regulator valve 64 is connected to the inlet and outlet side of triplex liquid pump 18 to allow setting the output pressure for triplex liquid pump 18. Also connected to the inlet side of triplex liquid pump 18 is liquid injector 36 which is connected to solenoid valves 22 and chemical supply bottles 24*a–d* in a manner previously described. Water flow 50 exits triplex liquid pump 18 to pulse hose 66 and piping 68. Pulse hose 66 serves to dampen the output of triplex liquid pump 18 to minimize the effects of water hammer. Water flow 50 continues through piping 68 to check valve 70 and heat exchangers 42. Check valve 70 ensures the heated water produced in the heat exchangers 42 does not flow back to triplex liquid pump 18 and damage its seals.

Water flow 50 flows through heat exchangers 42 in series as previously described where it is heated and exits through piping 72 to fitting 74 where temperature gauge 76 is connected. Water flow 50 then proceeds to cross 78 into which pressure gauge 80 is connected. The water flow 50 is split at this point. One path for water flow 50 is to selector valve 82. Selector valve 82 allows water flow 50 to be directed to water outlet 84 where it is taken by hose to the operator's wand for use. If selector valve 82 is switched, water flow 50 is then directed to ball valve 86 and then to water flow exit hose 88. The second path for water flow 50 exiting cross 78 is through ball valve 90 to water flow exit hose 88. Ball valves 86 and 90 are needed to maintain the proper flow rate of water flow 50 through heat exchanger 42 to ensure the proper water temperature is obtained. The position of these ball valves is set during assembly and is not disturbed afterward.

Figure 4:
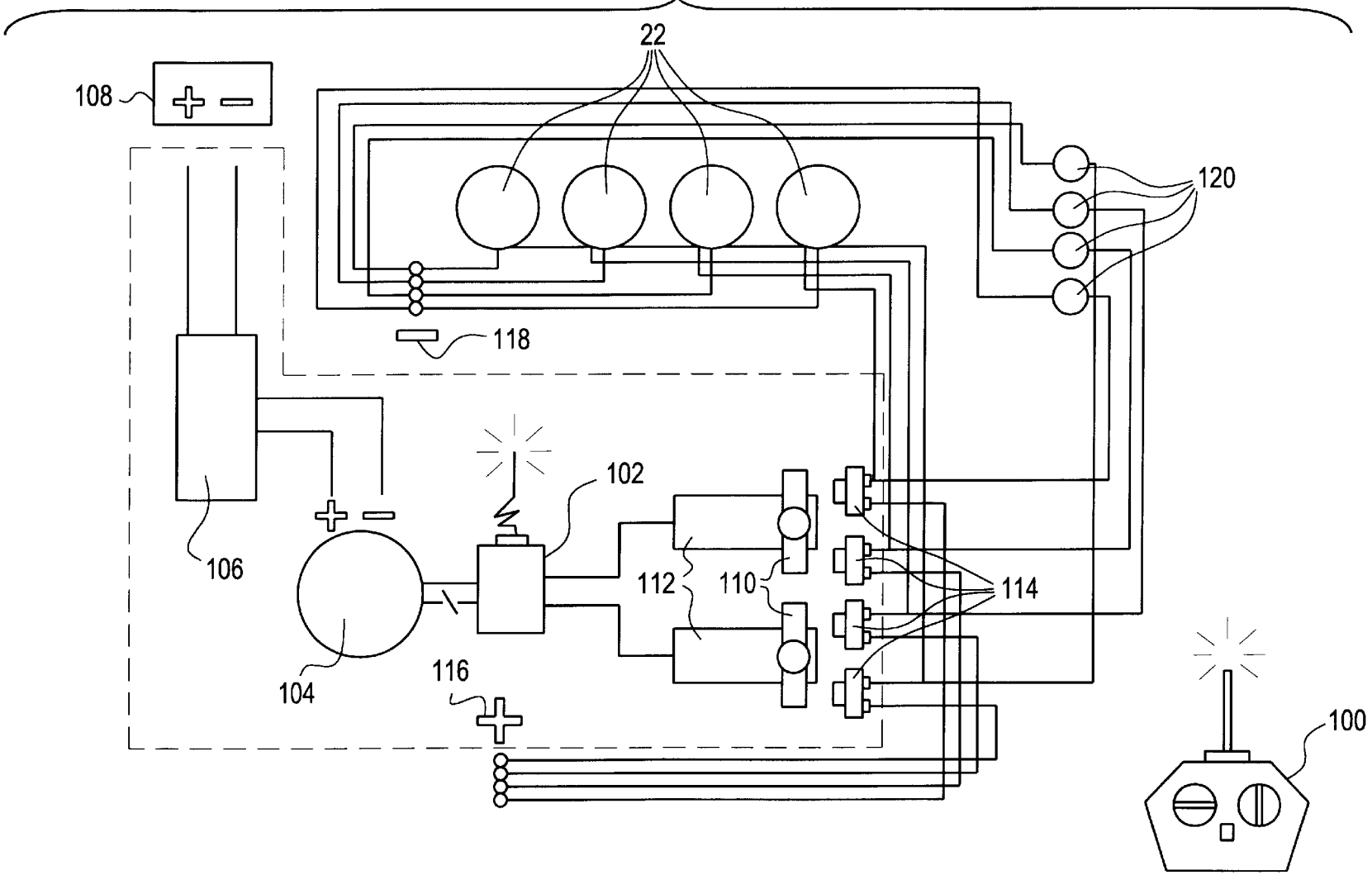
FIG. 4 is an electrical diagram of the remote controlled carpet cleaner.

The method by which solenoid valves 22 are controlled and operated are best understood by referring to the electrical diagram of FIG. 4. A radio controlled transmitter 100 is worn by the operator on his belt where it is easily accessible. When the operator wishes to open or close a solenoid valve the appropriate switch is flipped on transmitter 100 to send a signal to radio receiver 102, mounted on rectangular outer support frame 12 and shown schematically in FIG. 4. In the preferred embodiment, the transmitter and receiver are of a type used in the control of radio controlled model aircraft. The radio receiver 102 is powered by rechargeable battery 104 which is connected to a built-in charger 106. The charger is designed to plug into the 12 volt power supply 108 of the truck to allow recharging between jobs. When a signal is received by radio receiver 102, the appropriate arm 110 of servo motors 112 is operated to activate pressure switches 114. Operation of pressure switches 114 then opens or closes the appropriate circuit to open or close solenoid valves 22 which are connected to positive source 116 and negative source 118 as shown. Indicator lights 120 are wired in series with solenoid valves 22 and pressure switches 114 and are then lighted when a particular solenoid valve 22 is opened.

The construction of my remote controlled carpet cleaner will be readily understood from the foregoing description and it will be seen I have provided an improved remote controlled carpet cleaner which offers a substantial increase in productivity by offering an operator the ability to remotely control and dispense required cleaning chemicals without making repeated trips between the cleaning site and a supply truck and by providing a remote controlled carpet cleaner which can be used without requiring the premixing of carpet cleaning chemicals. My remote controlled carpet cleaner also may be used without requiring the spraying of chemicals prior to use thereby reducing airborne solvents in a customer's home or business. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. A remote controlled carpet cleaner, said remote controlled carpet cleaner comprising:

a liquid pump driven by an engine, a heat exchanger, said heat exchanger receiving exhaust gases from said engine to heat a liquid pumped through said heat exchanger by said liquid pump, a liquid injector attached to said liquid pump, a plurality of remotely controlled valves connected to said liquid injector to control the flow of cleaning chemicals to said liquid pump, and said plurality of remotely controlled valves controlled by a receiver in response to a signal generated by a transmitter carried by an operator.

2. A remote controlled carpet cleaner according to claim 1 wherein:

said remotely controlled solenoid valves are operated by a pressure switch activated by a servo motor in response to said receiver signal.

3. A remote controlled carpet cleaner according to claim 2 wherein:

said remotely controlled valves are solenoid valves.

4. A remote controlled carpet cleaner according to claim 3 further including:

a vacuum pump driven by said engine, and a cleaning wand connected by flexible hose to said remote controlled carpet cleaner.

5. A remote controlled carpet cleaner according to claim 4 wherein:

said flexible hose has first and second parts, said first part connected to said remote controlled carpet cleaner and supplying heated water to said cleaning wand, and said second part connected to said vacuum pump of said remote controlled carpet cleaner.

6. A method of operating a remote controlled carpet cleaner including a liquid pump driven by an engine to pump a liquid through a heat exchanger which receives exhaust gases from said engine to heat said liquid, a liquid injector attached to said liquid pump to inject cleaning chemicals supplied through solenoid valves, said solenoid valves controlled by a receiver in response to a signal generated by a transmitter carried by an operator, said method comprising the steps of:

transmitting a signal from an operator carried transmitter to a receiver, receiving said signal from said operator carried transmitter to said receiver, operating a switch in response to a signal from said receiver, opening a solenoid valve in response to the operation of said switch, and dispensing a carpet cleaning chemical through said solenoid valve to said liquid injector.

7. A method of operating a remote controlled carpet cleaner according to claim 6 wherein:

said signal transmitted from an operator carried transmitter to a receiver is a radio signal.

8. A method of operating a remote controlled carpet cleaner according to claim 7 wherein:

said switch is a pressure activated switch operated by a servo motor.

* * * * *